US009814920B1

(12) United States Patent
Monterrey

(10) Patent No.: US 9,814,920 B1
(45) Date of Patent: Nov. 14, 2017

(54) EXERCISE APPARATUS TO ENHANCE MUSCLE RECRUITMENT OF A USER THROUGH ISOMETRIC AND PLYOMETRIC MOVEMENTS

(71) Applicant: Jensen Franz Monterrey, Menifee, CA (US)

(72) Inventor: Jensen Franz Monterrey, Menifee, CA (US)

( * ) Notice: Subject to any disclaimer, the term of this patent is extended or adjusted under 35 U.S.C. 154(b) by 0 days.

(21) Appl. No.: 15/642,019

(22) Filed: Jul. 5, 2017

(51) Int. Cl.

| | |
|---|---|
| ***A63B 21/005*** | (2006.01) |
| ***A63B 21/02*** | (2006.01) |
| ***A63B 21/00*** | (2006.01) |
| ***A63B 21/002*** | (2006.01) |
| ***A63B 21/055*** | (2006.01) |
| ***A63B 24/00*** | (2006.01) |
| ***A63B 5/00*** | (2006.01) |
| ***A63B 71/06*** | (2006.01) |
| *A63B 23/04* | (2006.01) |

(52) U.S. Cl.
CPC ..... *A63B 21/0023* (2013.01); *A63B 5/00* (2013.01); *A63B 21/00069* (2013.01); *A63B 21/026* (2013.01); *A63B 21/0552* (2013.01); *A63B 21/154* (2013.01); *A63B 21/4035* (2015.10); *A63B 24/0087* (2013.01); *A63B 71/0622* (2013.01); *A63B 2023/0411* (2013.01); *A63B 2220/50* (2013.01)

(58) Field of Classification Search
CPC ..... A63B 21/00069; A63B 21/0023; A63B 21/026; A63B 21/0552; A63B 21/154; A63B 21/4035; A63B 5/00; A63B 71/0622; A63B 24/0087; A63B 2023/0411; A63B 2220/50
See application file for complete search history.

(56) References Cited

U.S. PATENT DOCUMENTS

| | | | | | |
|---|---|---|---|---|---|
| 3,861,215 | A | * | 1/1975 | Bradley | A63B 21/015 482/116 |
| 4,138,106 | A | * | 2/1979 | Bradley | A63B 21/0058 482/116 |
| 4,479,647 | A | * | 10/1984 | Smith | A63B 21/0058 482/4 |
| 5,154,684 | A | * | 10/1992 | Delf | A63B 21/015 482/116 |
| 5,269,737 | A | * | 12/1993 | Sobotka | A63B 21/0552 482/123 |

(Continued)

*Primary Examiner* — Joshua Lee
(74) *Attorney, Agent, or Firm* — Plager Schack LLP; Mark H. Plager

(57) ABSTRACT

An exercise apparatus to enhance muscle recruitment of a user includes a base platform, a rotatable shaft coupled to the base platform, a brake assembly coupled to the base platform and operably connected to the rotatable shaft, the brake assembly having a controller designed to engage and disengage the brake assembly from the rotatable shaft, and a pair of cables with first ends coupled to the rotatable shaft and second ends coupled to a bar. The controller engages the brake assembly with the rotatable shaft to lock the rotatable shaft in a stationary position for a predetermined time to permit the user to perform an isometric movement with the bar. The controller disengages the brake assembly from the rotatable shaft after the predetermined time to permit the rotatable shaft to rotate to permit the user to perform a plyometric movement with the bar.

8 Claims, 4 Drawing Sheets

(56) References Cited

U.S. PATENT DOCUMENTS

| | | | | |
|---|---|---|---|---|
| 6,027,429 | A * | 2/2000 | Daniels | A63B 21/0056 482/111 |
| 6,368,251 | B1 | 4/2002 | Casler | |
| 6,612,170 | B2 * | 9/2003 | Brown | A63B 21/0023 73/379.06 |
| 8,845,499 | B1 * | 9/2014 | Boatwright | A63B 21/015 482/116 |
| 2010/0093493 | A1 | 4/2010 | Eldridge | |
| 2014/0213414 | A1 | 7/2014 | Balandis | |
| 2015/0375045 | A1 | 12/2015 | Ojanen | |

* cited by examiner

EXERCISE APPARATUS TO ENHANCE MUSCLE RECRUITMENT OF A USER THROUGH ISOMETRIC AND PLYOMETRIC MOVEMENTS

BACKGROUND

The embodiments herein relate generally to devices to recruit muscles of a user for training, rehabilitation and exercise purposes.

Individuals perform a wide variety of movements such as isotonic, isometric, isokinetic and plyometric exercises to recruit, strengthen and develop different muscle groups. Individuals with busy lives continually seek exercise routines that target different muscle groups with greater efficiency.

Several training and exercise devices exist as disclosed in U.S. Pat. No. 6,368,251, U.S. Patent Application Publications 2015/0375045, 2014/0213414 and 2010/0093493. These devices permit the user to perform a variety of movements and/or exercises with varied resistance. However, these devices are limited because they comprise several complex components and/or are limited in their ability to allow the user to alternate the performance of different types of exercises quickly during a single workout session.

As such, there is a need in the industry for an exercise apparatus to enhance muscle fiber recruitment of a user that addresses the limitations of the prior art. There is a further need for an exercise apparatus that is configured to provide resistance for a period of time to enable the user to perform an isometric contraction followed by a release of resistance to permit the user to perform a plyometric contraction against a light or minimal load.

SUMMARY

An exercise apparatus configured to enhance muscle recruitment of a user through a performance of alternating isometric and plyometric movements is provided. The exercise apparatus comprises a base platform comprising a top face and a lower face opposite the top face, a rotatable shaft coupled to the base platform, a brake assembly coupled to the base platform and operably connected to the rotatable shaft, the brake assembly comprising a controller configured to engage the brake assembly with the rotatable shaft to maintain the rotatable shaft in a stationary position and disengage the brake assembly from the rotatable shaft to permit the rotatable shaft to rotate, and a pair of cables comprising first ends coupled to the rotatable shaft and second ends coupled to a bar, each cable in the pair of cables operably connected to a plurality of pulleys coupled to the base platform, wherein the controller is configured to engage the brake assembly with the rotatable shaft to lock the rotatable shaft in a stationary position for a predetermined time to permit the user to perform an isometric movement with the bar, wherein the controller is configured to disengage the brake assembly from the rotatable shaft after the predetermined time to permit the rotatable shaft to rotate in a first direction to permit the user to perform a plyometric movement with the bar.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
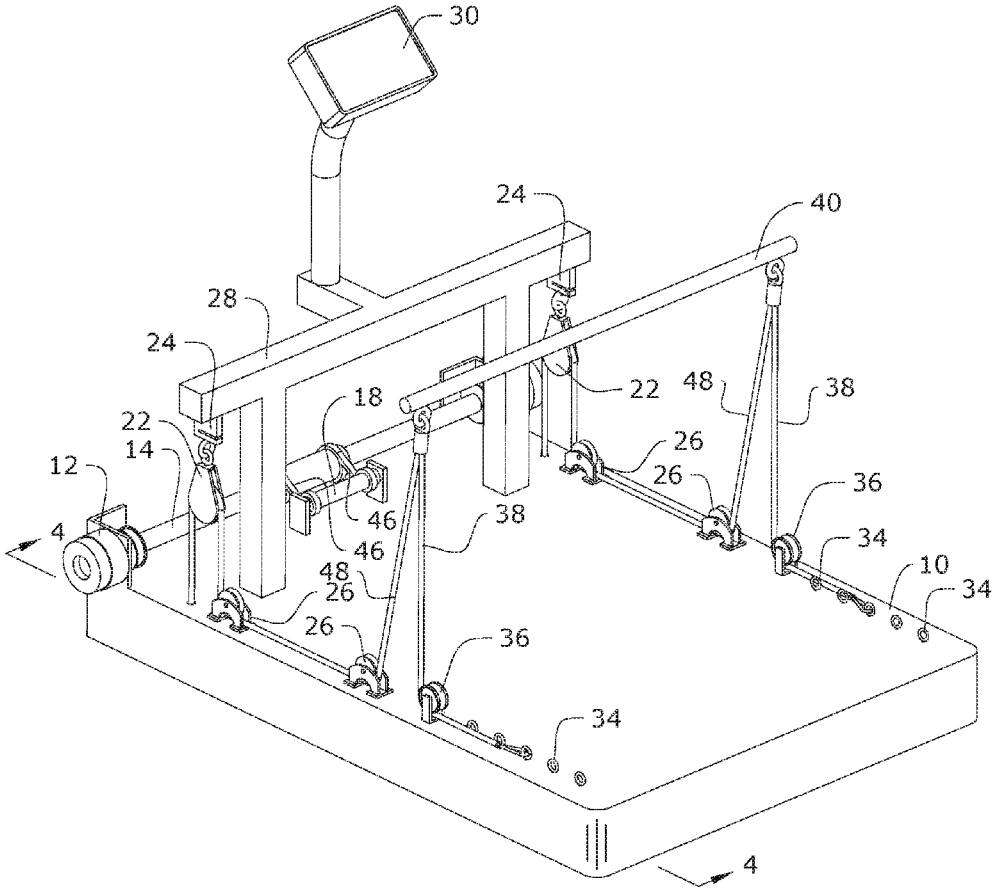
FIG. 1 depicts a top perspective view of certain embodiments of the exercise apparatus.
Figure 2:
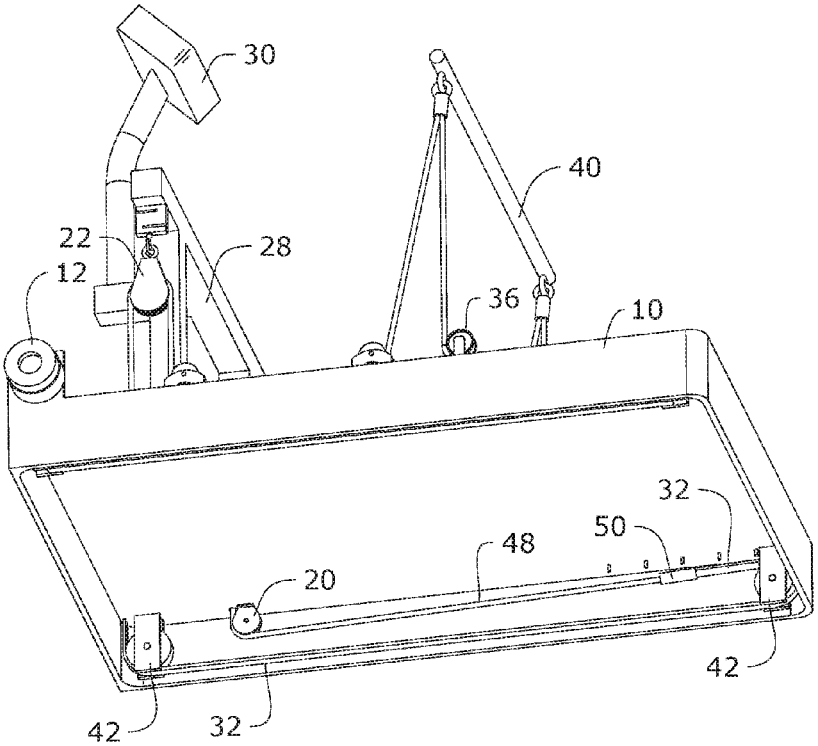
FIG. 2 depicts a bottom left perspective view of certain embodiments of the exercise apparatus.
Figure 3:
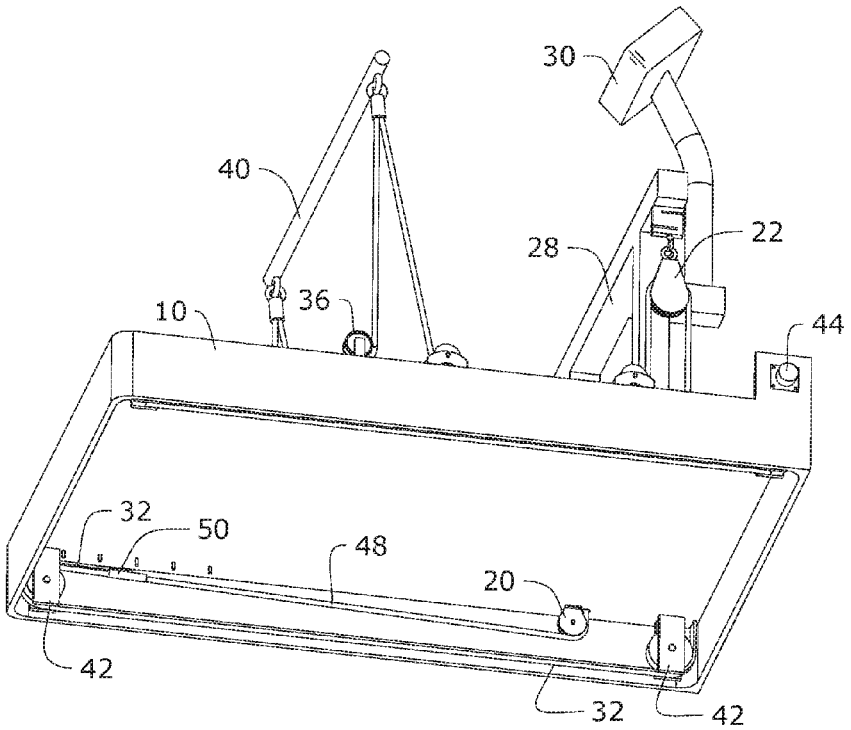
FIG. 3 depicts a bottom right perspective view of certain embodiments of the exercise apparatus.
Figure 4:
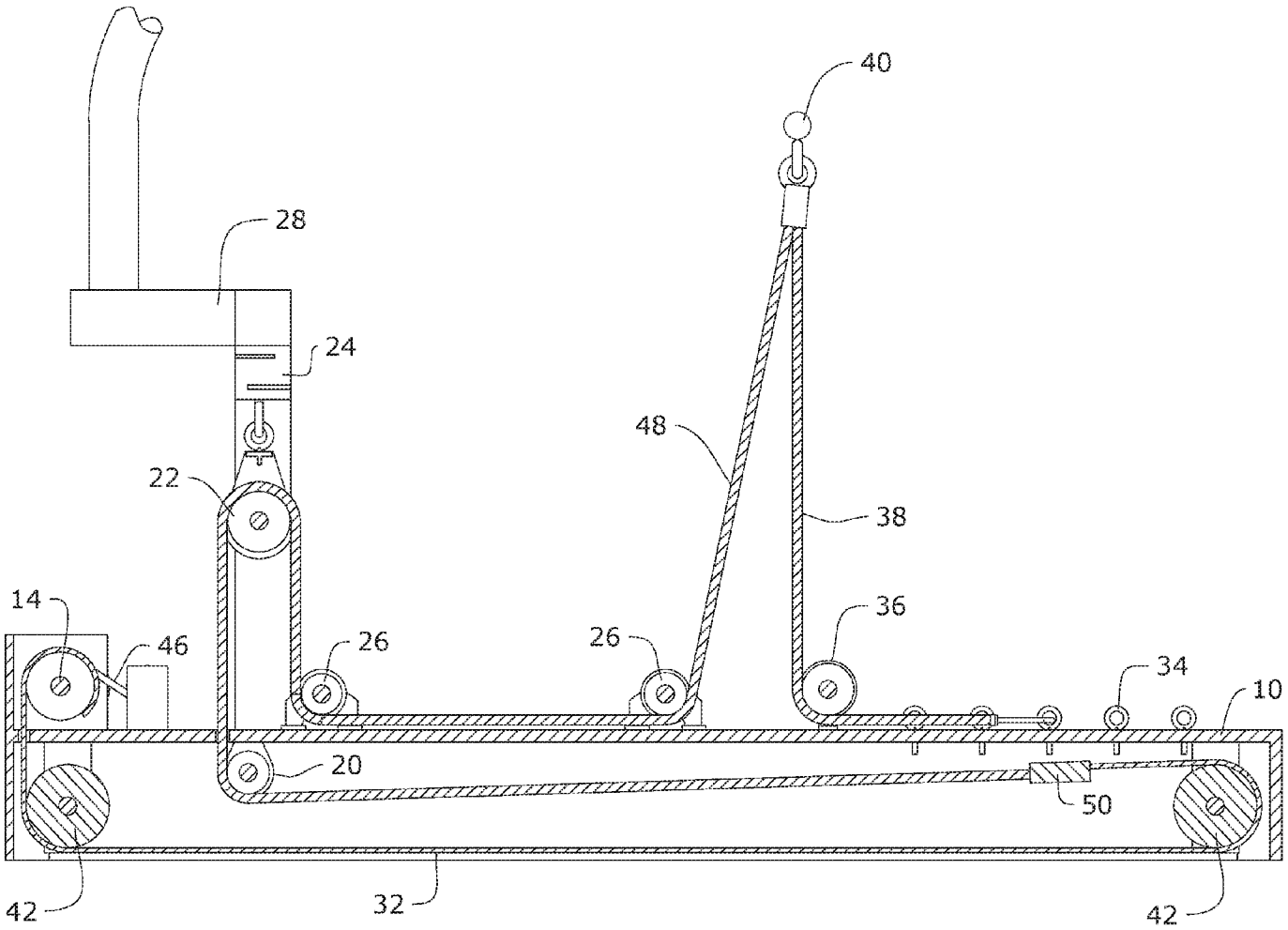
FIG. 4 depicts a section view of certain embodiments of the exercise apparatus taken along line 4-4 in FIG. 1.

As depicted in FIGS. 1-3, the exercise apparatus is configured to maximize muscle fiber recruitment of the user by enabling him/her to perform a set of alternating isometric and plyometric movements within a single session. Alternatively, the exercise apparatus can be programmed to permit the user to perform solely isometric or plyometric movements during a session.

In certain embodiments, the exercise apparatus generally comprises base 10, main shaft 14, brake assembly 12, human machine interface 30, resistance tubes 38, cables 48 and exercise bar 40. Base 10 is disposed on a ground surface and comprises a top face and a lower face. Main shaft 14 is rotatably mounted to a front portion of base 10 on the top face. Brake assembly 12 is coupled to base 10 and operably connected to main shaft 14.

In certain embodiments, brake assembly 12 comprises a brake element, electric brake controller and programmable logic controller (PLC). The PLC controls the electric brake controller, which is configured to engage the brake element with main shaft 14 or disengage the brake element from main shaft 14. Human machine interface 30 is coupled to base 10 by load cell support 28. The user can interact with human machine interface 30 to program the PLC and control the operation of brake assembly 12 as desired.

Once the brake element of brake assembly 12 is engaged, main shaft 14 is locked in a stationary position. Once the brake element of brake assembly 12 is disengaged, main shaft 14 is free to rotate. A return spring assembly is coupled to base 10 and comprises spring shaft 18 and a pair of return springs 46. The pair of return springs 46 are coupled to spring shaft 18 and operably connected to main shaft 14. The rotation of main shaft 14 in a first direction causes return springs 46 to generate tension to rotate main shaft 14 in a second direction opposite the first direction to return main shaft 14 to a resting configuration.

As depicted in FIG. 3, encoder 44 is coupled to main shaft 14 and is configured to generate operation data pertaining to at least a rotation speed and direction of rotation of main shaft 14. In certain embodiments, the operation data from encoder 44 is transmitted to the PLC and/or electric brake controller to control the operation of brake assembly 12. As a result, the engagement and disengagement of the braking element of brake assembly 12 is operated based on the operation data.

Exercise bar 40 is operably connected to main shaft 14 and serves as a handle for the user to grab to perform isometric or plyometric movements. More specifically, exercise bar 40 is operably connected to main shaft 14 by a pair of cables 48 and a pair of straps 32. As depicted in FIGS. 1-4, each strap 32 is coupled to cable 48 by connector 50. The end of each strap 32 is coupled to one of the ends of main shaft 14. Each strap 32 and corresponding cable 48 are connected together and extend from main shaft 14 through a hole in base 10 and along the bottom face of base 10. Strap 32 and/or cable 48 are coupled to the bottom face of base 10 by flat idler pulleys 42 and lower mounted pulley 20. Cable 48 extends from lower mounted pulley 20 through a hole in base 10 and above the top face of base 10. Cable 48 is coupled to base 10 above the top face by hanging pulley 22 and upper mounted pulleys 26. The end of each cable 48 is coupled to an end of exercise bar 40 by fasteners such as an eyebolt and/or clip.

In one embodiment, the pair of hanging pulleys 22 are coupled to load cell support 28. Each hanging pulley 22 is operably connected to force sensor 24, which measures the force being applied to cable 48. This is particularly useful because force sensor 24 generates data pertaining to the magnitude of force applied to cable 48 by the user via exercise bar 40. The data pertaining to the applied force can be transmitted to and displayed on human machine interface 30.

The ends of exercise bar 40 are coupled to a pair of resistance tubes 38. Each resistance tube 38 comprises a first end coupled to exercise bar 40 by fastening components such as a clip and a second end coupled to one of a plurality of eyebolts 34 on base 10. The tension in resistance tube 38 can be varied depending on which eyebolt 34 the second end of resistance tube 38 is coupled to. Each resistance tube 38 is operably connected to idler pulley 36, which is coupled to the top face of base 10. In a preferred embodiment, resistance tubes 38 are made from a stretchable and resilient material.

In operation, the user programs brake assembly 12 of the exercise apparatus such that the electric brake controller engages the brake element with main shaft 14 for a predetermined time such as one second. The predetermined time can be adjusted as desired via human machine interface 30. The user performs a set of alternating isometric and plyometric movements with exercise bar 40 as desired.

In one exemplary embodiment, the user performs a squat jump on base 10. The user positions his/her legs on base 10 and places hands on exercise bar 40. Once the exercise apparatus is enabled, the brake element of brake assembly 12 engages with main shaft 14 to lock the main shaft in a stationary position. Since exercise bar 40 is directly connected to main shaft 14 by straps 32 and cables 48, exercise bar 40 cannot move upward. The user pushes up on stationary exercise bar 40 to perform an isometric exercise.

Figure 5:
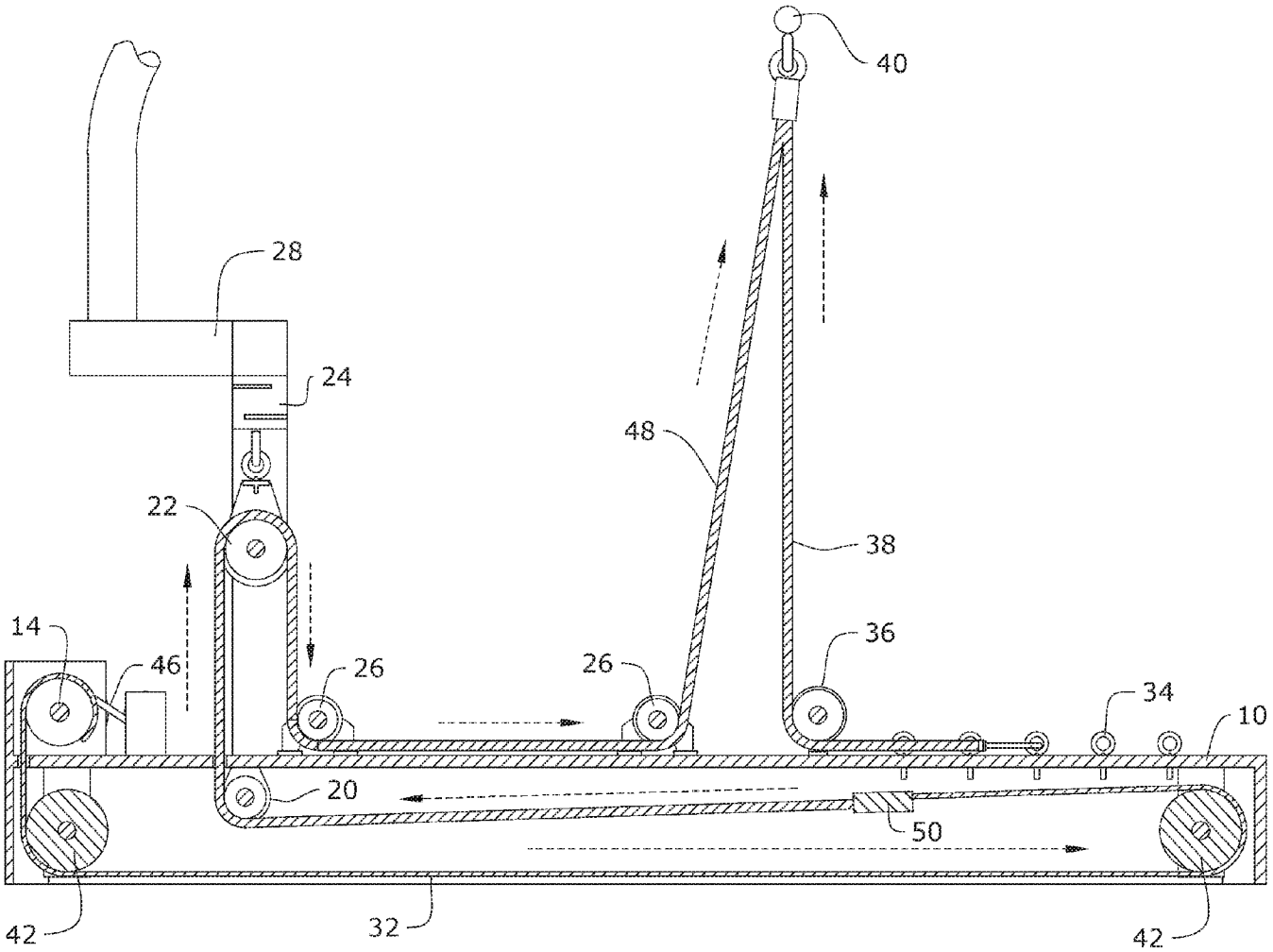
FIG. 5 depicts a section view of certain embodiments of the exercise apparatus in use.

After one second passes or an alternate programmed predetermined time, the brake element of brake assembly 12 disengages with main shaft 14. As depicted in FIG. 5, this permits main shaft 14 to freely rotate, which permits exercise bar 40 to be pushed upward by the movement of straps 32 and cables 48 through the connected pulleys. The user pushes up on exercise bar 40 and performs a jump to complete a plyometric movement. During this jump, resistance tubes 38 apply additional resistance to exercise bar 40.

As the user lands on base 10 to complete the jump, straps 32 and cables 48 retract by generated tension from return springs 46 of the return spring assembly. This causes main shaft 14 to rotate in a second direction opposite the first direction to return main shaft 14 to a resting configuration. Encoder 44 recognizes the change in rotational direction of main shaft 14 and signals the electric brake controller to engage the brake element of brake assembly 12 with main shaft 14 again. The user continues to perform the alternating isometric and plyometric movements as desired. As a result, the exercise apparatus provides resistance to exercise bar 40 for a period of time to enable the user to perform an isometric contraction followed by a release of resistance to permit the user to perform a plyometric contraction against a light or minimal load. A repetition of these movements greatly enhances muscle fiber recruitment of the user.

It shall be appreciated that the user can perform alternative isometric and plyometric movements with the exercise apparatus. For example, the user may perform deadlifts, military presses, and other exercises with exercise bar 40. In an alternative embodiment, the user can perform the series of movements by connecting one or more cables 48 to alternate handles or a vest attached to the user's body. As a result, similar benefits can be achieved without the use of exercise bar 40.

It shall be appreciated that the components of the exercise apparatus described in several embodiments herein may comprise any known materials in the field and be of any color, size and/or dimensions. It shall be appreciated that the components of the exercise apparatus described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An exercise apparatus configured to enhance muscle recruitment of a user through a performance of alternating isometric and plyometric movements, the exercise apparatus comprising:

a base platform comprising a top face and a lower face opposite the top face;

a rotatable shaft coupled to the base platform;

a brake assembly coupled to the base platform and operably connected to the rotatable shaft, the brake assembly comprising a controller configured to engage the brake assembly with the rotatable shaft to maintain the rotatable shaft in a stationary position and disengage the brake assembly from the rotatable shaft to permit the rotatable shaft to rotate; and a pair of cables comprising first ends coupled to the rotatable shaft and second ends coupled to a bar, each cable in the pair of cables operably connected to a plurality of pulleys coupled to the base platform;

a return spring assembly coupled to the base platform and operably connected to the rotatable shaft, the return spring assembly comprising a pair of springs coupled to the rotatable shaft and configured to generate tension to rotate the rotatable shaft in a second direction opposite the first direction to return the rotatable shaft to a resting configuration;

a pair of resistance tubes comprising first ends coupled to the bar and second ends coupled to the base platform, each resistance tube in the pair of resistance tubes comprising a stretchable and resilient material;

wherein the controller is configured to engage the brake assembly with the rotatable shaft to lock the rotatable shaft in a stationary position for a predetermined time to permit the user to perform an isometric movement with the bar, wherein the controller is configured to disengage the brake assembly from the rotatable shaft after the predetermined time to permit the rotatable shaft to rotate in a first direction to permit the user to perform a plyometric movement with the bar.

2. The exercise apparatus of claim 1, further comprising a pair of idler pulleys coupled to the base platform, each resistance tube in the pair of resistance tubes operably connected to one of the pair of idler pulleys.

3. The exercise apparatus of claim 2, further comprising a plurality of eyebolts coupled to the base platform, wherein the second end of each resistance tube in the pair of resistance tubes is configured to couple to any one of the plurality of eyebolts to vary tension in the resistance tube.

4. The exercise apparatus of claim 3, further comprising a plurality of eyebolts coupled to the base platform, wherein the second end of each resistance tube in the pair of resistance tubes is configured to detachably couple to any one of the plurality of eyebolts to adjust tension in the resistance tube.

5. The exercise apparatus of claim 4, further comprising a human machine interface coupled to the base platform and operably connected to the controller, the human machine interface configured to permit the user to program the controller to vary the predetermined time of engagement of the brake assembly with the rotatable shaft.

6. The exercise apparatus of claim 5, further comprising an encoder coupled to the rotatable shaft and configured to generate operation data pertaining to at least a rotation speed and direction of rotation of the rotatable shaft, wherein the controller is configured to operate the engagement and disengagement of the brake assembly based on the operation data.

7. The exercise apparatus of claim 6, further comprising a pair of force sensors operably connected to the pair of cables, each force sensor in the pair of force sensors configured to generate data pertaining to a magnitude of force applied to one of the pair of cables by the user via the bar.

8. The exercise apparatus of claim 7, wherein the plurality of pulleys comprises a first set of pulleys coupled to the top face of the base platform and a second set of pulleys coupled to the bottom face of the base platform.

* * * * *